US005530213A

United States Patent [19]

Hartsock et al.

[11] Patent Number: 5,530,213

[45] Date of Patent: Jun. 25, 1996

[54] SOUND-DEADENED MOTOR VEHICLE EXHAUST MANIFOLD

[75] Inventors: Dale L. Hartsock, Livonia; Larry V. Reatherford, Warren; Ernest D. Stiles, St. Clair Shores; Matthew J. Zaluzec, Canton, all of Mich.

[73] Assignee: Ford Motor Company, Dearborn, Mich.

[21] Appl. No.: 257,222

[22] Filed: Jun. 8, 1994

Related U.S. Application Data

[63] Continuation of Ser. No. 61,952, May 17, 1993, abandoned.

[51] Int. Cl.[6] ..... F01N 7/10

[52] U.S. Cl. ..... 181/240; 428/685

[58] Field of Search ..... 181/227, 228, 181/240, 244, 282, 222, 252, 256, 290; 138/143, 145, DIG. 6; 428/685, 937, 553, 35.8

[56] References Cited

U.S. PATENT DOCUMENTS

| | | | |
|---|---|---|---|
| 1,512,961 | 10/1924 | Weil | 138/323 |
| 2,975,072 | 3/1961 | Bryant et al. | 181/244 X |
| 3,337,939 | 8/1967 | Parkinson | 181/244 X |
| 4,373,331 | 2/1983 | Santiago et al. | 60/323 X |
| 4,382,487 | 5/1983 | Baumann | 181/282 |
| 4,537,027 | 8/1985 | Harwood et al. | 60/323 |
| 4,685,534 | 8/1987 | Burstein et al. | 181/251 |
| 4,695,516 | 9/1987 | Masuhara et al. | 181/244 X |
| 4,729,937 | 3/1988 | Yamazaki | 430/65 |
| 4,729,939 | 3/1988 | Shinoda et al. | 181/244 X |
| 4,745,988 | 5/1988 | Hardt et al. | 181/249 |
| 4,793,544 | 12/1988 | Fukuda | 181/244 X |
| 4,851,298 | 7/1989 | Fukuda | 181/243 X |
| 5,018,661 | 5/1991 | Cyb | 60/323 X |
| 5,032,469 | 7/1991 | Merz et al. | 428/685 X |
| 5,151,308 | 9/1992 | Moskowitz et al. | 428/35.8 |

*Primary Examiner*—Khanh Dang

*Attorney, Agent, or Firm*—Jerome R. Drouillard; Roger L. May

[57] ABSTRACT

An automotive exhaust manifold is fabricated from stainless steel sheet metal of thin dense gauge, and provided with an outer coating of less dense stainless steel or other suitable material spray bonded to it to provide an irregular surface of non-uniform cross-section with a large surface area to damp the transmission of sound waves from the manifold.

5 Claims, 1 Drawing Sheet

SOUND-DEADENED MOTOR VEHICLE EXHAUST MANIFOLD

This application is a continuation of application Ser. No. 08/061,952, filed May 17, 1993, abandoned.

FIELD OF THE INVENTION

This invention relates in general to a motor vehicle type manifold, and more particularly to an exhaust manifold fabricated of sheet metal.

BACKGROUND OF THE INVENTION

A large majority of motor vehicle exhaust manifolds are made from conventional cast iron for strength and durability and other reasons. However, these manifolds are heavy and therefore detract from the fuel economy of the vehicle, as well as not being able to be easily fabricated into different shapes as with a sheet metal manifold. A further disadvantage is the motor vehicle underhood packaging constraints of cast iron manifolds.

A solution to the above is to provide a thin tubular, fabricated exhaust manifold out of a sheet metal that is light in weight and complies more easily with underhood packaging constraints. A disadvantage of sheet metal manifolds, however, is their tendency to transmit objectionable noise levels into the vehicle passenger compartment because of their thin wall nature.

The present invention overcomes the above disadvantage, or objection, by reducing the noise emanating from a sheet metal manifold without sacrificing the desired features of such a manifold. More particularly, the invention provides an outer coating onto the shell of the manifold that is irregular in surface and provides a high, or large surface area that damps the ability of the thin sheet metal manifold shell to transmit noise, or sound waves.

DESCRIPTION OF THE PRIOR ART

None of the prior art shows or describes metal coatings on the outside of a thin sheet metal manifold that are less dense than the manifold and of a highly irregular surface providing a large surface area to deaden the sound transmitting characteristics of the manifold. Much of the prior art shows manifolds coated for the purpose of preventing the transmission of heat from the manifold, but these generally are of a material with a surface essentially the same as that of the manifold shell and may or may not be of the same density. Or, the insulating material may be sandwiched between layers of metal, unlike of the present invention.

For example, U.S. Pat. No. 3,337,939 to Parkinson describes a muffler constructed with an inner thin layer of stainless steel and an outer thicker layer of aluminum coated carbon steel separated by a sound deadening material.

U.S. Pat. No. 4,582,298 and U.S. Pat. No. 4,793,544 to Fukuda describe a muffler made from two overlapping sheets, the inner one of stainless steel to resist corrosion due to combustion chemical reaction gas, while the outer one is of aluminum or zinc-coated steel plate. FIG. 5 shows a buffered layer of sound-deadening material between the layers. FIG. 6 describes the use of the inner and outer stainless steel layers and a thick plain steel sheet in between, for reducing noise transmission.

U.S. Pat. No. 4,382,487 to Baumann describes a sheet steel muffler with enamel coating on the inside for rust protection. FIG. 8 describes the use of stainless steel wool to improve the damping effect of the exhaust muffler, the wool being fused (not shown) to the inner wall of the muffler sheath 25, i.e., the wall of the exhaust gas pipe inside the muffler.

U.S. Pat. No. 4,745,988 to Hardt et al. describes an exhaust system silencer made of aluminum to protect against corrosion, or to coat a steel silencer with aluminum for corrosion protection.

U.S. Pat. No. 4,695,516 to Masuhara et al., and U.S. Pat. No. 4,729,929 to Shinoda et al. describe precoating sheet metal steel for heat and corrosion resistance so as to make it suitable for use in the manufacture of mufflers and the like.

U.S. Pat. No. 1,512,961 to Weil is an example of a tubular sheet metal manifold in which the inner surface alone or both the inner and outer surfaces can be coated with a porcelain material to protect it against corrosion and heat.

U.S. Pat. No. 5,018,661 to Cyb describes a sheet metal/cast metal exhaust manifold 10 with a heat resistant lining on the inside of the manifold (0.010–0.050 inch thickness) to act as a heat shield to channel the heat out of the exhaust system or downstream to a catalytic converter. The liner is formed by spraying a mixture of fuel and air with a powder compound onto the inner surface in a conical pattern. FIG. 5 describes forming the liner by plasma/arc spraying. The compounds used are those noted for their heat resistant qualities. The liner is substantially dense, and therefore transmits sound better.

U.S. Pat. No. 2,970,072 to Bryant et al. describe a steel sheet metal muffler having a nickel plate coating topped with a porcelain coating for corrosion and weathering resistance.

U.S. Pat. No. 4,537,027 to Harwood et al. describes a sheet metal exhaust manifold having inner and outer stamped sheet metal shells.

U.S. Pat. No. 4,685,534 to Burstein et al. describes a muffler having a rust or corrosion resistant ceramic coating, a two-sheet outer shell in which the inner layer is heavy gauged steel or any impact resistant material, such as fiberglass, and an outer layer formed by coating the inner layer with a rust and corrosion resistant material.

SUMMARY OF THE INVENTION

The invention provides a tubular sheet metal manifold of thin dense stainless steel that is plasma or wire arc sprayed with a coating of less dense stainless steel or other suitable coating material having an essentially continuous irregular surface area of non-uniform cross-section with highly efficient sound dampening characteristics that lessen the transmission of noise or sound waves from the manifold shell.

Other features, advantages and objects of the invention will become more apparent upon reference to the succeeding, detailed description thereof, and to the single sheet of drawing containing the preferred embodiment thereof, wherein there is illustrated a cross-sectional view of a portion of a sheet metal manifold embodying the invention.

DESCRIPTION OF THE PREFERRED EMBODIMENT

Figure 1:
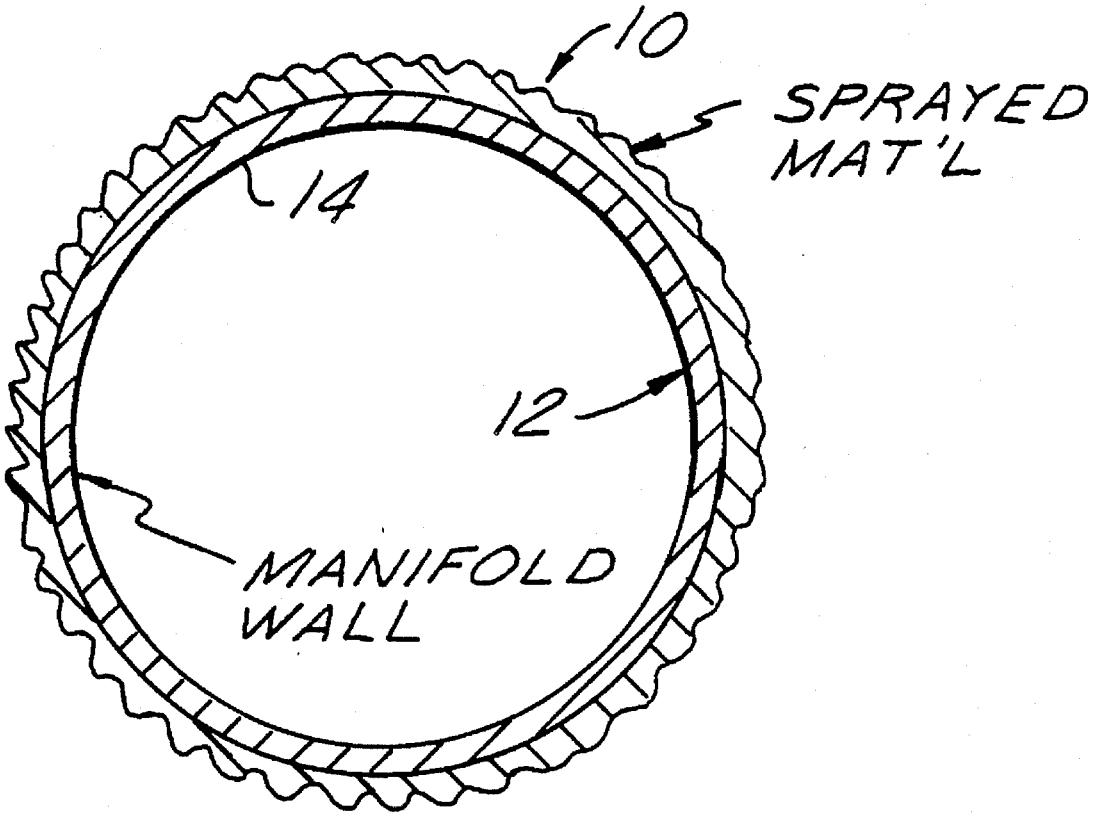
FIG. 1 is an illustration of a tubular exhaust manifold according to the present invention.

The FIGURE shows a portion 10 of a tubular type exhaust manifold. More particularly, it shows a shell 12 fabricated, in this case, from a piece of thin gauge (0.070 inches)

standard stainless steel. It provides a relatively dense, smooth, thin manifold wall 14 that is light in weight and can be fabricated easily into shapes that are easily adaptable to the underhood characteristics of present day motor vehicles. The thin gauge and light weight advantageously reduces the overall vehicle weight and adds to the fuel economy, as compared to conventional cast iron manifolds. However, as stated previously, due to the relatively thin wall nature of the fabricated steel manifolds, the noise or NVH (Noise/Vibration/Harkness) characteristics may sometimes be considered unacceptable. This can result in objectionable noise levels being transmitted from the manifold into the vehicle passenger compartment as a result of the vibrational frequency characteristics of the wall.

As stated previously, the invention eliminates or substantially reduces the above objection by coating the outer wall of the manifold with a layer of less dense stainless steel or other suitable, compatible metal material by a plasma or wire arc spraying procedure that produces a highly irregular surface that is uneven in cross-section and produces jagged edges that interrupt the transmission of sound waves from the manifold wall. This low density, porous, high surface area outer stainless steel or similar material coating that is bonded to the exterior surfaces of the manifold combines with the manifold to produce a non-uniform cross-section, rendering a manifold wall that does not transfer sound as readily as an uncoated component. Furthermore, a cost savings can be realized by using a lighter gauge base material for the manifold wall and utilizing the coating material to provide the desired overall thickness and corrosion resistance.

The plasma or wire arc spraying process or procedure described to apply the coating to the manifold wall is known in the prior art, and its details, therefore, are not given as they are believed to be unnecessary for an understanding of the invention. Suffice it to say, however, a gas such as air, nitrogen or argon would be fed into a plasma spray gun and passed between electrodes to be ionized by a high voltage arc passing between the electrodes. This would ionize the gas and form it into a plasma capable of obtaining very high temperatures. The metal wire feedstock used to form the coating would be fed into the gun to enter the plasma downstream of its arc where it would be melted, atomized and caught up therein and sprayed from the outlet of the thermal spray gun and applied to the outside of the manifold tubular section wall. Obviously, other procedures and other arc sprayed coating materials can be used instead of stainless steel, producing other desired results and effects without departing from the scope of the invention.

From the foregoing, it will be seen that the invention provides a fabricated stainless steel manifold of lightweight sheet metal with a dense manifold wall spray coated with a less dense stainless layer having a non-uniform cross-section providing an irregular outer exterior surface of the jagged edge type providing excellent sound dampening characteristics or qualities that reduce the transmission of sound waves from the manifold. The coating also provides a way of controlling the overall thickness of the manifold wall, and therefore permits the use of varying gauge metal for the manifold wall for controlling the overall weight of the vehicle.

While the invention has been shown and described in its preferred embodiment, it will be clear to those skilled in the arts to which it pertains that many changes and modifications may be made thereto without departing from the scope of the invention.

We claim:

1. An automotive exhaust manifold construction consisting of a shell of dense thin sheet metal, with said shell having an outer surface with the ability to transmit sound, and having a sound deadening outer coating of less dense metal material with an irregular surface area greater than the shell outer surface to damp the ability of the shell to transmit the sound.

2. A manifold construction as in claim 1, wherein the irregular surface area is porous, uneven and rough, thereby providing an essentially continuous, jagged-like surface breaking up sound waves emanating from the shell.

3. A manifold construction as in claim 1, wherein the outer coating consists of a material sprayed onto said shell outer surface in a manner to provide a large uneven surface coating of non-uniform thickness.

4. A manifold construction as in claim 3, wherein the shell is of a thin dense tubular stainless steel with a uniform outer surface and the coating is a lower density, irregular large surface area of stainless steel.

5. A tubular steel automotive exhaust manifold construction comprising a tubular shell of dense essentially smooth and thin stainless steel sheet metal of uniform cross-section, the shell having an outer coating bonded thereto consisting of a less dense stainless steel coating of non-uniform cross-section that is sprayed onto the shell using a wire arc spraying process to provide a large irregular surface area to minimize noise waves emanating from the shell.

* * * * *